US008002566B1

(12) United States Patent
Baumann et al.

(10) Patent No.: US 8,002,566 B1
(45) Date of Patent: Aug. 23, 2011

(54) SELF-LOCKING ELECTRICAL CONNECTOR

(75) Inventors: Frederick B. B. Baumann, Claremont, CA (US); Ramon A. Figueroa, La Verne, CA (US)

(73) Assignee: HiRel Connectors, Inc., Claremont, CA (US)

( * ) Notice: Subject to any disclaimer, the term of this patent is extended or adjusted under 35 U.S.C. 154(b) by 0 days.

(21) Appl. No.: 12/872,271

(22) Filed: Aug. 31, 2010

Related U.S. Application Data

(60) Provisional application No. 61/267,941, filed on Dec. 9, 2009.

(51) Int. Cl.
*H01R 4/38* (2006.01)

(52) U.S. Cl. ..... 439/321; 285/82

(58) Field of Classification Search ..... 439/312–323; 285/81–93

See application file for complete search history.

(56) References Cited

U.S. PATENT DOCUMENTS

| | | | | |
|---|---|---|---|---|
| 3,917,373 A | | 11/1975 | Peterson | |
| 4,034,788 A | | 7/1977 | Melone | |
| 4,502,748 A | | 3/1985 | Brush, Sr. et al. | |
| 4,506,942 A | | 3/1985 | Flederbach et al. | |
| 4,900,260 A | * | 2/1990 | Drogo | 439/321 |
| 5,046,964 A | * | 9/1991 | Welsh et al. | 439/271 |
| 5,181,860 A | * | 1/1993 | Honma et al. | 439/321 |
| 5,192,219 A | * | 3/1993 | Fowler et al. | 439/321 |
| 5,199,894 A | | 4/1993 | Kalny et al. | |

FOREIGN PATENT DOCUMENTS

| | | |
|---|---|---|
| GB | 2127234 | 4/1984 |

* cited by examiner

*Primary Examiner* — Thanh Tam Le
(74) *Attorney, Agent, or Firm* — Denton L. Anderson; Sheldon Mak & Anderson PC

(57) ABSTRACT

A self-locking electrical connector has (a) a first shell body for receiving a first set of contacts; (b) a clamping ring for holding the first set of contacts in engagement with a second set of contacts; (c) a multiplicity of first detent members; (d) a multiplicity of second detent members; and (e) biasing means for holding the first and second detent members in facing engagement. The biasing means includes at least one spring washer, an end cap and a retaining ring retained within the clamping ring. The at least one spring washer is disposed between the detent members and the end cap. The end cap is axially movable by a force applied by the retaining ring between (i) a non-mated position wherein the at least one spring washer applies less than a desired amount of force to the detent members, and (ii) a mated position wherein the at least one spring washer applies a precise amount of desired force to the detent members.

16 Claims, 6 Drawing Sheets

SELF-LOCKING ELECTRICAL CONNECTOR

CROSS-REFERENCE TO RELATED APPLICATIONS

This application claims priority from Provisional Patent Application Ser. No. 61/267,941, filed Dec. 9, 2009, entitled "SELF-LOCKING CONNECTOR II," and which is incorporated in its entirety herein.

FIELD OF THE INVENTION

The present invention relates to electrical connectors that are typically used in high-performance aircraft and other vehicles, that must withstand severe vibration and other adverse environmental conditions.

BACKGROUND OF THE INVENTION

Connector assemblies for severe environments are typically held in mating engagement by a clamp ring of one connector portion threadingly engaging the mating connector portion. Traditionally, the clamp ring is held in its clamping state by having the ring configured with a single lead thread having a pitch of about 20 threads per inch, and by the use of safety wire. More recently, coarser and/or multiple-lead threads have been preferred for permitting rapid coupling and uncoupling of the assemblies. Connectors of this type include those known as "Series III" connectors that are specified in standard shell sizes 9-25 for many high-performance applications according to MIL-C-38999/26D (dated May 7, 1990).

When Series III connectors are subjected to heavy vibration, it is required that the mating portions maintain a solid metal-to-metal face contact. It is also required that the performance under vibration be maintained even after a certain minimum number of complete engagements and disengagements of the mating portions. For this purpose, some form of locking device is provided for the clamp ring. One form of locking device presently in use includes a set of ratchet teeth that project outwardly from a first shell member, one or more detent members being carried on respective spring members by a threaded clamp ring that is rotatably connected to the first shell member. Rotation of the ring in a clamping direction for clamping to a second shell member is accompanied by ratcheting of the detent members over the teeth, the teeth each having a moderately inclined first ramp surface that resists the clamping direction of rotation. Also, each of the teeth has a more steeply inclined second ramp surface that heavily resists rotation of the ring in an opposite, unclamping direction.

Prior art connectors are typically subject to one or more of the following disadvantages:

1. The locking device is ineffective in that it does not maintain the required solid metal-to-metal face contact in that the discrete detent positions do not necessarily lie in phase with the fully clamped position of the ring such that even a slight vibration can cause the ring to back off slightly, the face-to-face contact being immediately lost when pressure is released from a compressively loaded elastomer that typically seals contact pins of the connector;

2. The locking device is ineffective in that the detent members do not prevent continued rotation in the unclamping direction, particularly after a number of engagement cycles, because the detent members have very little contact surface area, rapidly wearing away the teeth; and 3. The locking device is unreliable in that harmful foreign matter is not excluded, being damaged when the connector is decoupled, such as when water freezes within the device.

A variation of the above-described prior art locking device has the detent members formed in pairs that are slightly out of phase for providing detent positions in a multiple of the number of teeth. Each pair of the detent members is located on a multiply supported counterpart of the spring member, designated, the spring member rocking slightly on a middle support, one of the detent members moving inwardly as the other moves outwardly between detent positions. This prior art configuration suffers from each of the above disadvantages except to the extent that the greater number of detent positions limits the backing off of the clamp ring to the first detent engagement. A further disadvantage of the configuration is that it is more expensive and complicated to assemble in that a multiple complement of the detent members is required for obtaining the same locking torque.

Yet another variation of the first above-described prior art locking device has the teeth projecting axially from a counterpart of the first shell member. Several of the detent members (typically four or six) are formed on an annular detent plate that has outwardly projecting tabs for keyed engagement with a counterpart of the clamp ring. The detent members are axially biased against the teeth of a wavy spring member. The spring member is supported within the clamp ring by a first retaining clip. A second retaining clip clamps against the first shell member opposite the teeth when the ring is advanced in the clamping direction of rotation. This prior art configuration, while failing to overcome the disadvantages of the previously described prior art configurations, has other serious problems. For example, the clamp ring must overcome the axial force from the spring member in addition to the other sources of resistance to clamping of the mating connector portions. Conversely, the spring member continuously urges the mating portions apart, hastening failure of the connector. Also, the retaining clips are considered to be unreliable, failure of the clip catastrophically rendering the clamp ring completely ineffective in holding the connector in its mated condition. Further, the spring member makes only spaced apart contact with the detent plate, typically at from three to six locations, subjecting the relatively thin plate to undesirable bending deflections between the spaced apart detent members that produce uncontrolled variations in the biasing forces, and possible failure of the detent plate by fatigue.

U.S. Pat. No. 5,199,894 ("the '894 patent") describes a locking device which represents a marked improvement over the aforementioned prior art. This patent, the contents of which are incorporated herein by reference, discloses a system for locking and unlocking a connector pair having a threaded clamping nut or ring that is rotatably coaxially supported on a first shell body for holding connector contacts in axial engagement. A multiplicity of first detent members angularly fixed relative to the clamping ring engage a corresponding multiplicity of second detent members fixed to the first shell body, and a cone-shaped spring washer axially holds the members in facing engagement, whereby a total surface contacting area of engagement between the detent members is at least 0.1 times the product of an average engagement pitch diameter and the width of engagement. The first and second detent members can engage at shallow contact angles of not more than about 40 degrees. The spring washer contacts the first detent ring, which can axially slidably engage an engagement surface fixed to the clamping ring, along a continuous annular contact path for uniform axial biasing of the detent members. The connector preferably includes an adjustment ring threadingly engaging the clamping ring for adjustably preloading the spring washer. The clamping ring is preferably axially movable relative to the first shell body between open and closed positions having associated spring biasing levels that contribute positively to an overall clamping force between mating connector portions. The connector also includes resilient O-ring members frictionally connecting the clamping ring and the first shell body for dampening vibrations therebetween, and for sealingly enclosing the detent members and the spring washer.

The reliance of the connector of the '894 patent on the use of the resilient O-ring members increases the expense and complexity of manufacturing the connector due to the necessity for very narrow tolerances in the dimensions of the O-ring members.

Also, the connector of the '894 patent requires the user to carefully adjust the tension on the spring washers by precisely adjusting the threaded end cap. Such requirement for careful adjustment of the tension on the spring washer is a problem for the manufacturer of the connector. If the tension on the spring washer is adjusted too high or too low, the connector will not meet specifications, will fail to function properly and will result in undue quantities of rejections.

Thus there is a need for a connector having a locking device that overcomes the above disadvantages.

SUMMARY OF THE INVENTION

The invention satisfies this need. The invention is a self-locking electrical connector comprising (a) a first shell body for receiving a first set of contacts; (b) a threaded clamping ring rotatably coaxially supported on the first shell body for holding the first set of contacts in axial engagement with a second set of contacts; (c) a multiplicity of first detent members supportively coaxially located in a fixed angular relation to the clamping ring; (d) a multiplicity of second detent members supportively coaxially located in a fixed angular relation to the first shell body; and (e) biasing means for axially holding the first and second detent members in facing engagement, the biasing means comprising at least one spring washer, an end cap and a retaining ring, the retaining ring being rigidly retained within the clamping ring, the at least one spring washer being disposed between the detent members and the end cap, the end cap being axially movable by a force applied by the retaining ring between (i) a non-mated position wherein the at least one spring washer applies less than a desired amount of force to the detent members and (ii) a mated position wherein the at least one spring washer applies a precise amount of desired force to the detent members, the end cap being axially movable between the non-mated position and the mated position by axial movement of the clamping ring.

DRAWINGS

These and other features, aspects and advantages of the present invention will become better understood with reference to the following description, appended claims and accompanying drawings where:

DETAILED DESCRIPTION OF THE INVENTION

The following discussion describes in detail one embodiment of the invention and several variations of that embodiment. This discussion should not be construed, however, as limiting the invention to those particular embodiments. Practitioners skilled in the art will recognize numerous other embodiments as well.

Figure 1A:
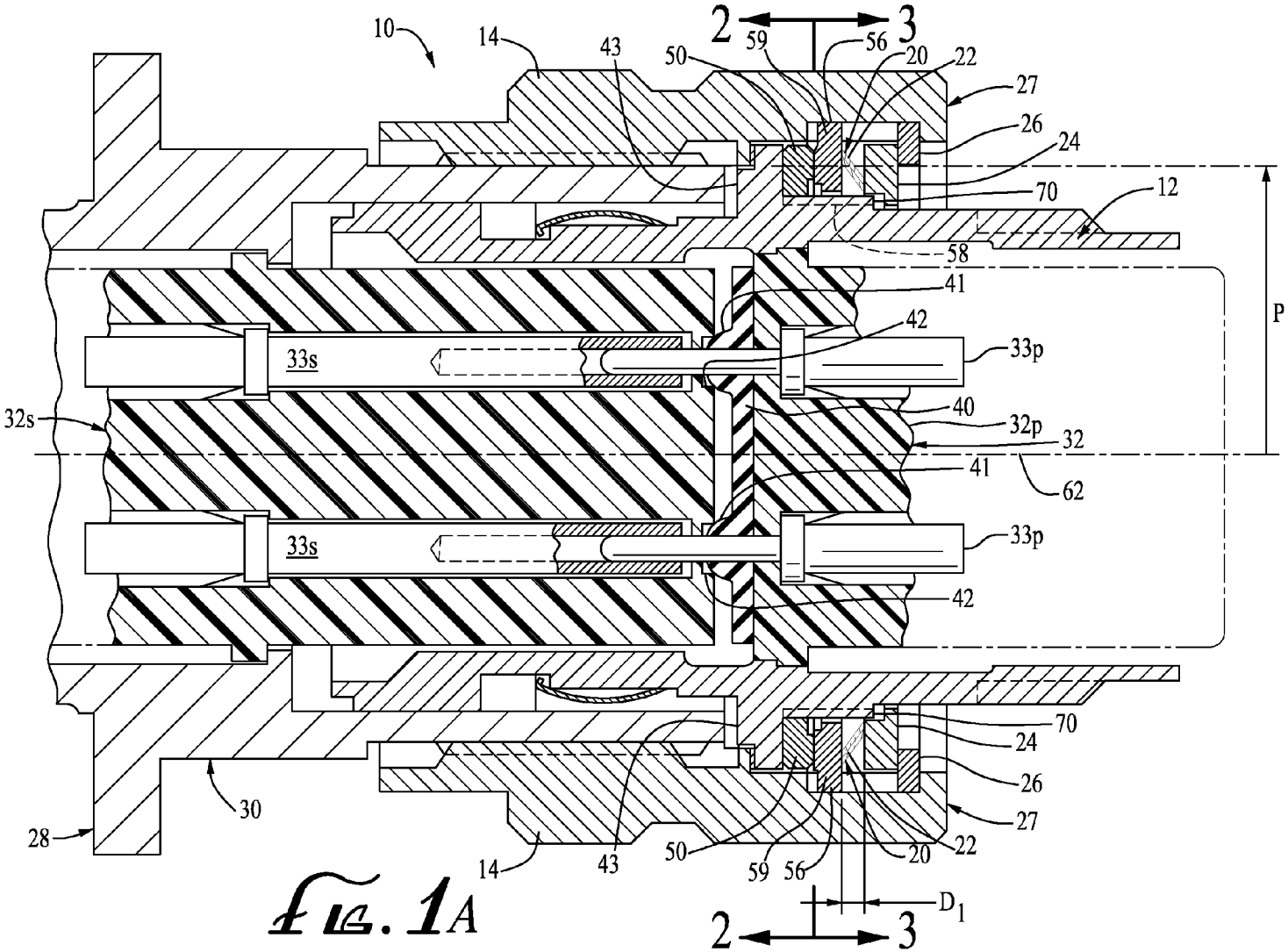
FIG. 1A is a fragmentary lateral section view of an electrical connector having features of the invention, shown in a non-mated configuration.
Figure 1B:
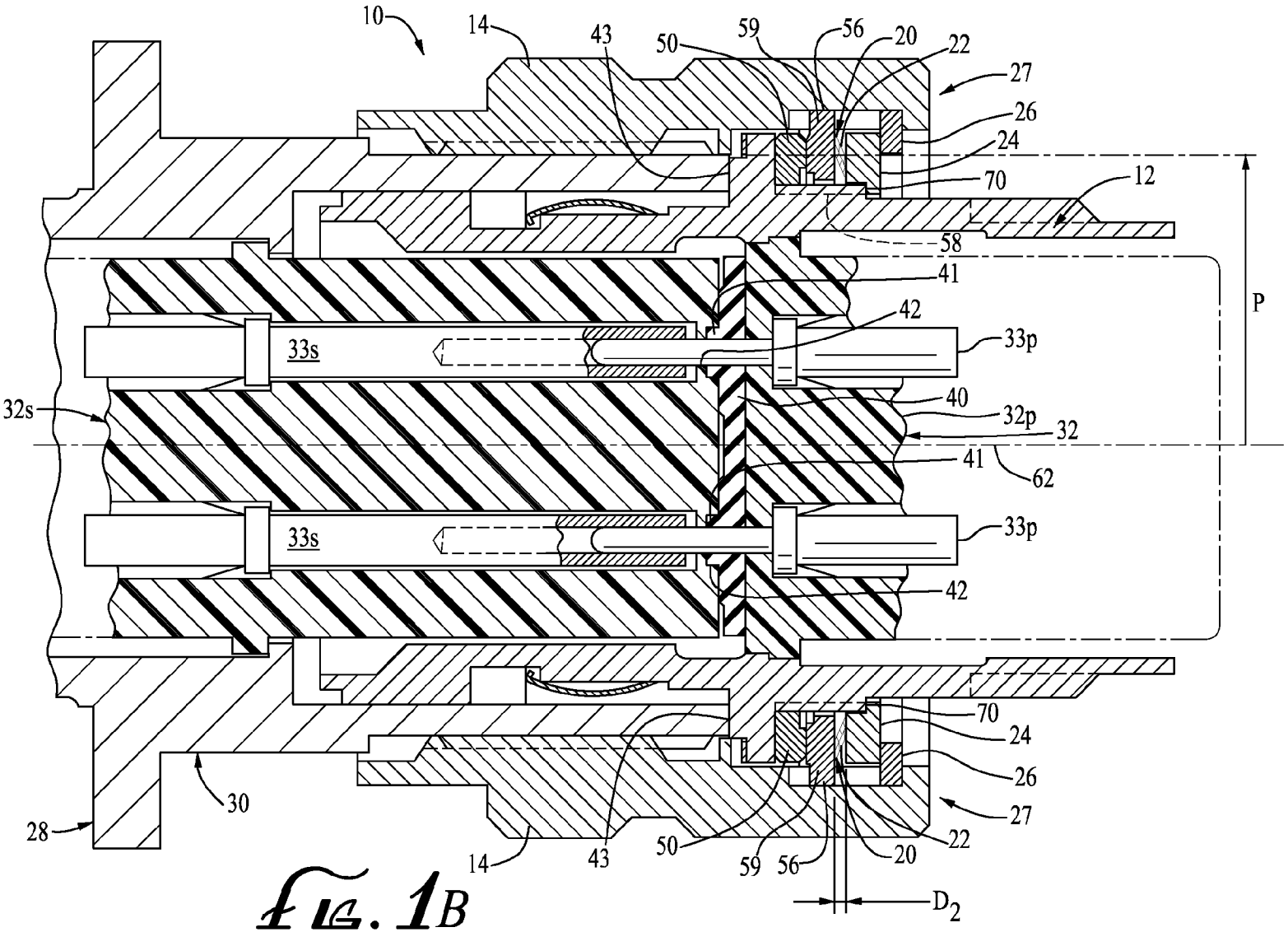
FIG. 1B is a second fragmentary lateral section view of the electrical connector illustrated in FIG. 1A, shown in a mated configuration.

The present invention is directed to an electrical connector 10 having an improved locking mechanism. The electrical connector 10 comprises a first shell body 12, a clamping ring 14, a multiplicity of first detent members 16, a multiplicity of second detent members 18 and biasing means 20 for axially holding the first and second detent members 18 in facing engagement. FIGS. 1A and 1B illustrate one embodiment of the invention wherein the connector 10 is typically constructed of aluminum.

The biasing means 20 comprises at least one spring washer 22, an end cap 24 and a retaining ring 26. The retaining ring 26 is rigidly retained within the clamping ring 14, and the at least one spring washer 22 is disposed between a second detent member ring 56, an end cap 24 and the retaining ring 26.

The end cap 24 is axially movable by a force applied by the retaining ring 26 between (i) a non-mated position (shown in FIG. 1A) wherein the at least one spring washer 22 applies less than a desired amount of force to the detent members, and (ii) a mated position (shown in FIG. 1B) wherein the at least one spring washer 22 applies a precise amount of desired force to the detent members. As illustrated in FIG. 1A, in the non-mated position, the end cap 24 and the retaining ring 26 are spaced apart from the second detent member ring 56 by a distance of $D_1$. The end cap 24 and the retaining ring 26 are axially moveable between the non-mated position and the mated position by axial movement of the clamping ring 14, so that, in the mated position, the end cap 24 and the retaining ring 26 are spaced apart from the second detent member ring 56 by the reduced distance of $D_2$.

The second detent members 18 axially project within the clamping ring 14 in fixed angular relation thereto, for engagement with a corresponding number of the first detent members 16 that are fixably located on the first shell member 12. The at least one spring washer 22 biases the first and second detent elements 16 and 18 into simultaneous engagement. In the embodiment illustrated in the drawings, the first detent members 16 are formed in one face of a first detent member ring 50, the first detent member ring 50 being fixably connected to a ratchet 58 of the first shell body 12. The second detent members are formed in one face of the second detent member ring 56. The detent members 16 and 18 are located on an average pitch diameter P, having a width of engagement W in a direction normal to a tangent of the pitch diameter P.

In the invention, it is very important that the thicknesses of the first detent member ring 50, the second detent member ring 56, the end cap 24 and the retaining ring 26 be carefully maintained within narrow tolerances. The thicknesses of each of these four components should preferably be maintained within a tolerance of 0.001 inches. The combined thickness of these four components should preferably be maintained within a tolerance of 0.005 inches.

In a typical embodiment, the movement of the end cap 24 between the non-mated position and the mated position compresses the at least one spring washer 22 by an additional distance of between about 0.015 inches and about 0.020 inches, and certainly by less than about 0.030 inches.

Also in a typical embodiment, the movement of the end cap 24 between the non-mated position and the mated position compresses the at least one spring washer 22 by adding an additional force of between about 100 psi and about 450 psi to the detent members.

By carefully monitoring the thicknesses of the first detent member ring 50, the second detent member ring 56, the end cap 24 and the retaining ring 26, the connector 10 can be conveniently assembled by the manufacturer without having to worry about inadvertently adjusting the tension on the at least one spring washer 22 too high or too low. The tension on the at least one spring washer 22 is automatically achieved—with no adjustment necessary by the assembler.

In the embodiments illustrated in the drawings, the at least one spring washer 22 is provided by a pair of conical spring washers, such as a pair of Belleville spring washers.

As illustrated in FIGS. 1A and 1B, the electrical connector 10 further comprises a first shell assembly 27 having the clamping ring 14 rotatably mounted concentric with the first shell body 12 and a second shell assembly 28 having a second shell body 30 that is threadingly engaged by the clamping ring 14 when the shell assemblies 27 and 28 are in a coupled configuration. The first shell body 12 and the second shell body 30 are typically made from aluminum.

Each of the assemblies 27 and 28 includes a contact assembly 32, designated pin assembly 32*p* and a socket assembly 32*s*. The contact assemblies 32 are interchangeably supported by the shell bodies 12 and 30, and have a suitable conventional configuration wherein one or more pins 33*p* of the pin assembly 32*p* engage a corresponding number of sockets 33*s* of the socket assembly 32*s*.

The pin assembly 32*p* includes a resilient interfacial seal member 40 having respective button portions 41 that are each protruded by one of the pins 33*p* for sealing a corresponding socket opening 42 of the socket assembly 32*s*. As shown in FIGS. 1A and 1B, each of the button portions 41 is compressively displaced by the socket assembly 32*s* from a rest configuration to an intermediate displacement wherein the second shell body 30 is spaced apart from a flange face surface 43 of the first shell member 12. The button portions 41 are further compressively displaced in a fully coupled position of the second shell assembly 28 wherein metal-to-metal contact is achieved between the second shell body 30 and the face surface 43.

Preferably, the ratchets 58 have tooth depths of between about 0.005 inches and about 0.009 inches and are disposed around the full 360° of the second detent member ring 56. Preferably, both the second detent member ring 56 and the ratchet 58 are made of a stainless steel, such as 304 stainless steel, to provide a high degree of wear resistance.

Figure 1C:
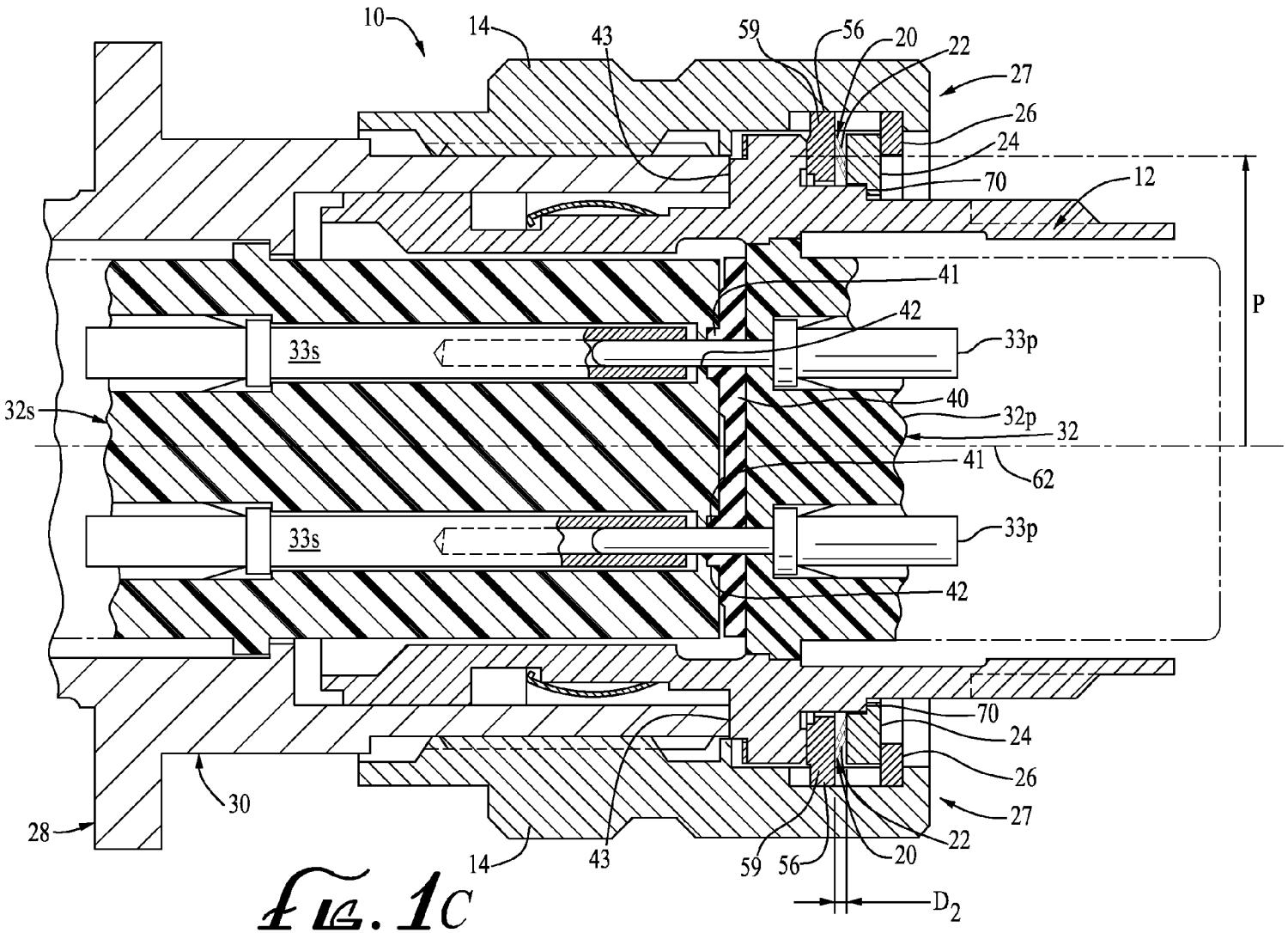
FIG. 1C is a fragmentary lateral section view of an alternative embodiment of an electrical connector having features of the invention, shown in a non-mated configuration.
Figure 2:
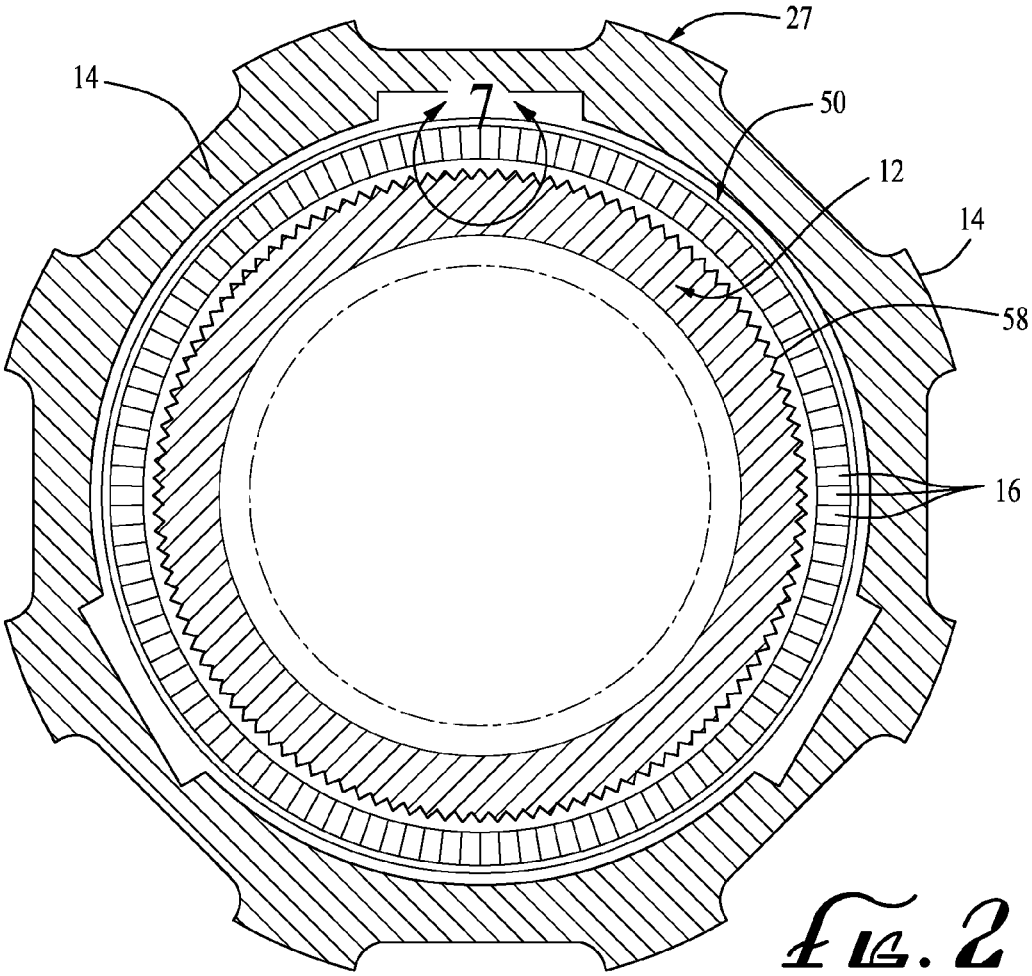
FIG. 2 is a cross-sectional view of the electrical connector illustrated in FIG. 1A, taken along line 2-2.

FIG. 1C illustrates an alternative embodiment substantially identical to the embodiment illustrates in FIGS. 1A and 1B, except that, in FIG. 1C, the connector is made from a stainless steel wherein the first detent members 16 are closely fit into the first shell body 12, such as being formed in one face of the first shell body 12. No first detent member 50 is employed in the connector illustrated in FIG. 1C. Also, in the embodiment illustrated in FIG. 1C, the ratchets 58 are no longer employed on the body 12, since the function of ratchets 58 in the connector illustrated in FIGS. 1A and 1B is to anchor the rotational movement of detent member 50.

Figure 9:
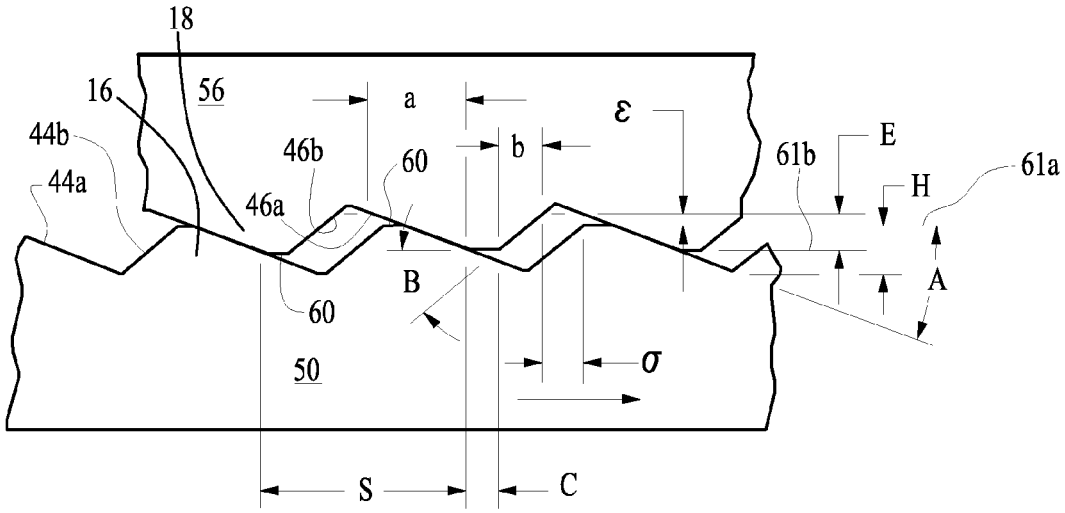
FIG. 9 is a lateral detailed diagrammatic view illustrating the detent members of the first detent member ring and the detent members of the second detent member ring.
Figure 3:
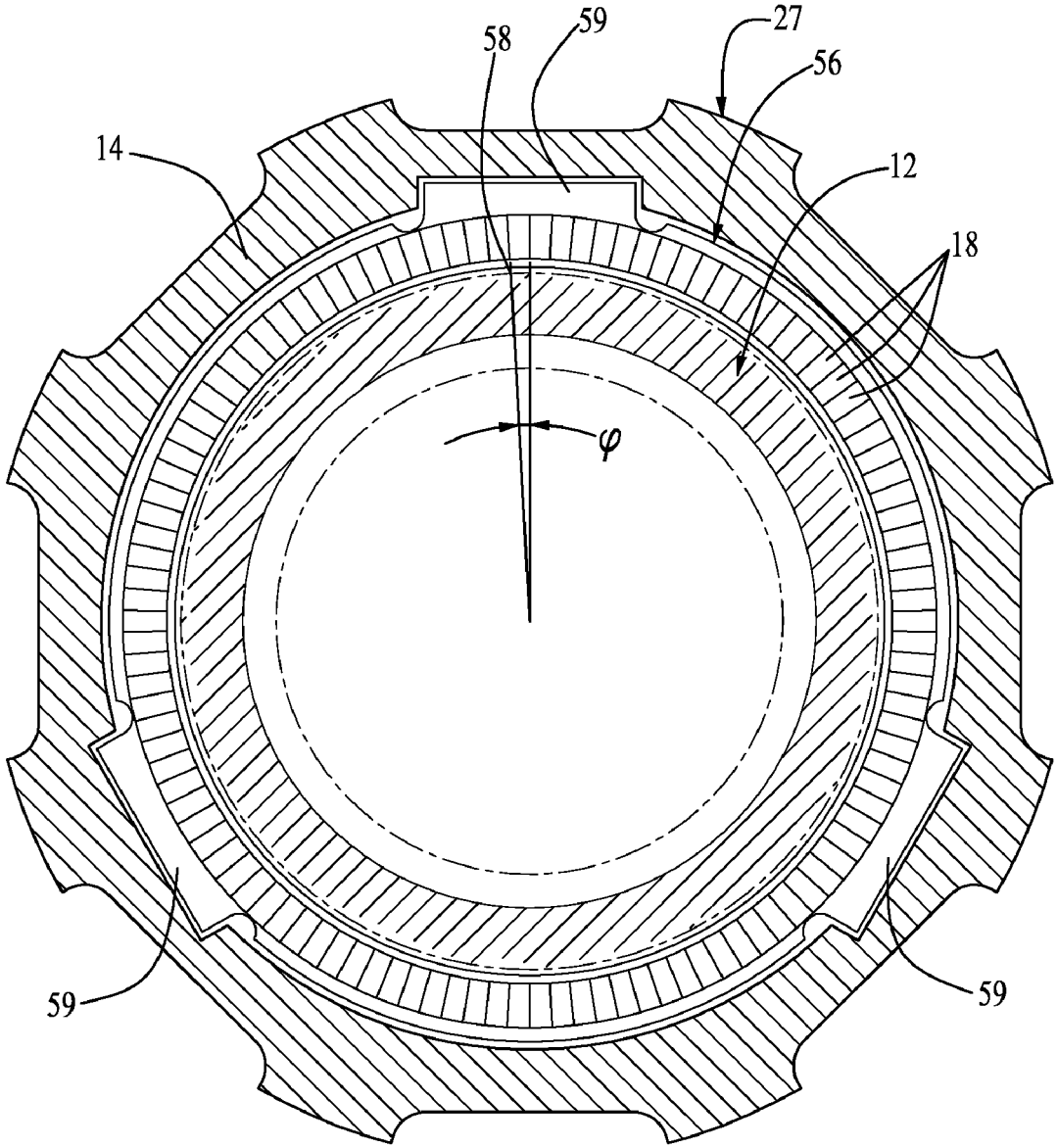
FIG. 3 is a cross-sectional view of the electrical connector illustrated in FIG. 1A, taken along line 3-3.
Figure 4:
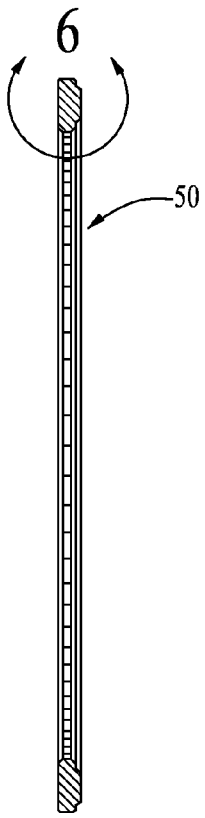
FIG. 4 is a side view of a portion of a first detent member ring useable in the invention.
Figure 7:
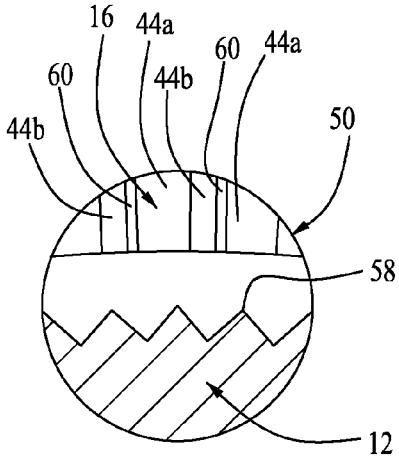
FIG. 7 is a detailed diagrammatic view of detent members useable in the detent member rings.
Figure 5:
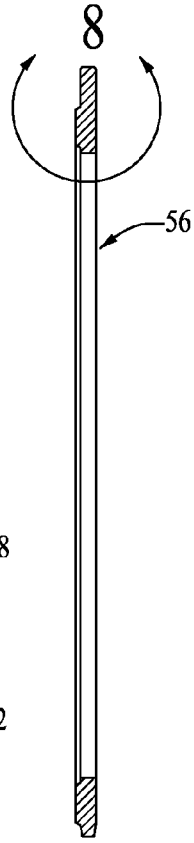
FIG. 5 is a side view of a portion of a second detent member ring useable in the invention.
Figure 6:
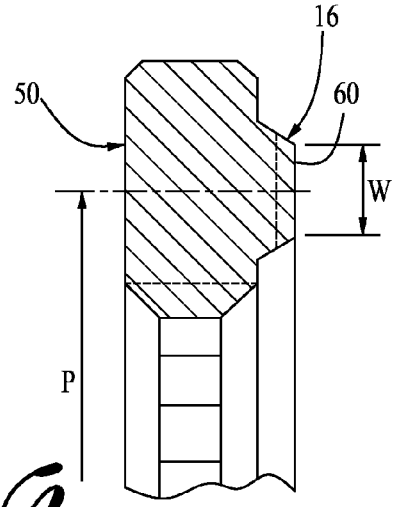
FIG. 6 is a detail view of the periphery of the first detent member ring illustrated in FIG. 4.
Figure 8:
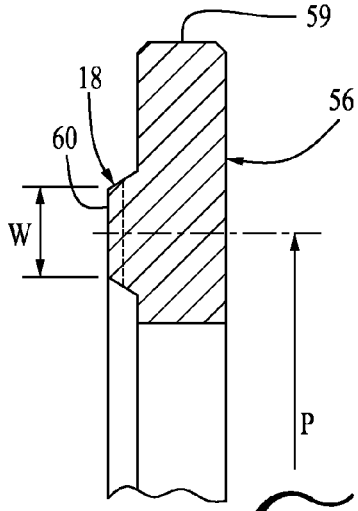
FIG. 8 is a detailed view of the periphery of the second detent member ring illustrated in FIG. 5.

As best shown in FIG. 9, the detent members 16 and 18 are each formed with a trapezoidal profile, being joined end-to-end at a circular pitch or spacing S and having a flattened crown portion 60 of width C. The crown portions 60 define respective crown surfaces 61*a* and 61*b* of the respective first and second detent member rings 50 and 56 in planes perpendicular to a central connector axis 62 in the electrical connector 10. It will be understood that the detent members 16 and 18, rather than forming a planar array, can alternatively be inclined for forming a cone-shaped array. In such case, the crown portions 60 would also lie in cone-shaped crown surfaces of the respective first and second detent member rings 50 and 56.

The second detent member ring 56 is slid over the flange portion 27 of the first clamping ring 14 and is secured by ratchet ears 59. In the embodiment illustrated in the drawing, three ratchet ears 59 are employed, each separated from the others by 120°.

A first ramp surface 44*a* and a corresponding first ramp surface 46*a* of each of the detent members 16 and 18 have a flat profile, sloping at a first ramp angle A from the crown surfaces 61*a* and 61*b* in a direction compressing the at least one spring washer 22 when the second detent member ring 56 is rotated with the clamping ring 14 in a first direction for clamping the second shell body 30 as indicated by the arrow in FIG. 9. Similarly, a second ramp surface 44*b* and a corresponding second ramp surface 46*b* of each of the detent members 16 and 18 have a flat profile, sloping at a second ramp angle B from the crown surfaces 61*a* and 61*b* in a direction compressing the at least one spring washer 22 when the second detent member ring 56 is rotated with the clamping ring 14 in an opposite second direction for releasing the second shell body 30.

As further shown in FIG. 9, when the detent members 16 and 18 are fully engaged, the first ramp surfaces 44*a* and 46*a* have a length of engagement a in the direction of the spacing S, and the second ramp surfaces 44*b* and 46*b* have a corresponding length of engagement b. When the clamping ring 14 is rotated in the clamping first direction, the rotation is resisted by an axial spring force F from the spring washer 22 that produces compressive loading between the first ramp surfaces 44*a* and 46*a* of the first and second detent member rings 50 and 56, the force F being distributed over a forward area of engagement. In FIG. 9, a is a circular distance of movement between the detent members 16 and 18 in the first direction relative to the fully engaged position, σ being less than a. Conversely, when the clamping ring 14 is rotated in the second direction for releasing the clamping, the force F is distributed over a reverse area of engagement, σ being less than b, taken in the second direction relative to the fully engaged position.

In a typical configuration of the electrical connector 10 for standard shell sizes 9 through 25, the number of detent members 16 and 18 ranges from approximately 50 in size 9 to in excess of 200 in size 25. Thus, an angle ϕ. between adjacent fully engaged positions of the first and second detent member rings 50 and 56 ranges from approximately 6° in a shell size 9 to approximately 3° in a shell size 25.

When the electrical connector 10 is configured generally as shown in FIGS. 1A and 1B, the average pitch diameter P ranges from approximately 0.6 inch in a shell size 9 to approximately 1.6 inch in a shell size 25.

The detent members 16 and 18 are preferably formed with a tooth height H of not more than approximately 0.01 inch, the angle A being not greater than approximately 30°, the angle B being not less than approximately equal to the angle A. Furthermore, the spacing S is preferably between approximately 0.03 inch and approximately 0.05 inch and the crown width C of the detent members 16 and 18 is preferably between approximately 0.003 inch and approximately 0.01 inch for providing a significant contact area between the crown portions 60 of detent members 16 and 18 when the first and second detent member rings 50 and 56 are moved between adjacent engagement positions, while preserving an even larger area of engagement between the first ramp surfaces 44*a* and 46*a*, and between the second ramp surfaces 44*b* and 46*b* through a large portion of the rotation of the first and second detent member rings 50 and 56 between the adjacent fully engaged positions. Correspondingly, a full engagement depth E between the first and second detent members 16 and 18 is preferably between about 0.0035 inch and about 0.009 inch. Dynamically, the depth E is reduced by a distance E during rotation of the clamping ring, where $\epsilon=\sigma \tan A$ in the first direction of rotation and $\epsilon=\sigma \tan B$ in the second direction of rotation. Similarly, a distance $\delta$ between opposite sides of the spring washer 22 decreases from $D_1$ and $D_2$, also according to the distance E.

The interlocking clutch plates 50 and 56 provide zero backlash even in an uncoupled state of the first shell assembly 10. When metal-to-metal contact occurs between the first shell member 43 and the second shell member 10, an internal metal-to-metal contact occurs between the first shell member 43 and the second shell member 10, an internal preload override feature comes into place. This feature provides for additional axial spring load to be applied to the engaged clutch plates 50 and 56, after axial movement of the clamping ring 14 by the distance T, which is limited by a shoulder 70 on the first shell member 12 and a corresponding surface on the cap member 24. This internal stop prevents over-stressing the spring washer 22. In this fully coupled mode, there is no rotation of movement of the coupling nut. After the metal-to-metal contact is achieved, the clamping ring 14 can be advanced 0.015 to 0.030 inches for further assuring continued maintenance of the metal-to-metal contact under severe vibration conditions. Even in a partially-mated condition, when there is no metal-to-metal plug/receptacle contact, the spring washer preload prevents clutch plates 50 and 56 from disengaging and allowing the shell assemblies 10 and 30 to uncouple during high vibration conditions.

The invention provides a high performance electrical connector which meets the requirement for MIL-C-38999 Series III connectors and is highly suitable for severe environments and critical electric components. The connector of the invention improves over the prior art in that the necessity for the use of O ring members is eliminated, thereby reducing the cost and complexity associated with the narrow tolerances required by such O ring members. Also, the connector of the invention does away with the requirement that the assembler carefully adjust the tension on the spring washer(s), thus eliminating the possibility that the spring washers will be inadvertently adjusted too high or too low.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A self-locking electrical connector comprising:

(a) a first shell body for receiving a first set of contacts;

(b) a threaded clamping ring rotatably coaxially supported on the first shell body for holding the first set of contacts in axial engagement with a second set of contacts;

(c) a multiplicity of first detent members supportively coaxially located in a fixed angular relation to the clamping ring;

(d) a multiplicity of second detent members supportively coaxially located in a fixed angular relation to the first shell body; and (e) biasing means for axially holding the first and second detent members in facing engagement, the biasing means comprising at least one spring washer, an end cap and a retaining ring, the retaining ring being rigidly retained within the clamping ring, the at least one spring washer being disposed between the second detent members and the end cap, the end cap being axially movable by a force applied by the retaining ring between (i) a non-mated position wherein the at least one spring washer applies less than a desired amount of force to the second detent members and (ii) a mated position wherein the at least one spring washer applies a precise amount of desired force to the second detent members, the end cap and the retaining ring being axially movable between the non-mated position and the mated position by axial movement of the clamping ring.

2. The connector of claim 1 wherein the movement of the end cap between the non-mated position and the mated position compresses the at least one spring washer by an additional distance of between about 0.015 inches and about 0.030 inches.

3. The connector of claim 1 wherein the movement of the end cap between the non-mated position and the mated position compresses the at least one spring washer by adding an additional force of between about 100 psi and about 450 psi to the detent members.

4. The connector of claim 1 wherein the first shell body and the first detent members are made of stainless steel and the first detent members are formed into the first shell body, the first detent members being capable of being locked in place by the second detent members which are disposed in a detent member ring.

5. The connector of claim 1 wherein the first and second detent members are simultaneously engagable on a detent pitch circle having an average detent pitch diameter P and having a detent engagement width W, and wherein a total surface contacting area of engagement between the detent members is at least 0.1 times the product of P and W, the biasing means providing a biasing force, the biasing force being distributed substantially uniformly among the first detent members, the first and second detent members being engagable in a multiplicity M of equally spaced positions having an angular spacing $\phi$ and an equivalent tangential spacing S, wherein the total surface contact area of engagement is maintained at not less than approximately 0.05 times the product of P and W during rotational movement of the second detent members relative to the first detent members through an angle not less than half of the angular spacing $\phi$.

6. The connector of claim 5 wherein the first and second detent members engage at a first contact angle A between a tangent of the pitch circle and a first surface of contact between each first detent member and a contacting second detent member during rotation of the clamping ring in a clamping directly relative to the first shell body, the angle A being not greater than approximately 30°.

7. The connector of claim 6 wherein the angle A is not greater than approximately 20°.

8. The connector of claim 6 wherein the first and second detent members engage at a second contact angle B between a tangent of the pitch circle and a second surface of contact between each first detent member and a contacting second detent member during rotation of the clamping ring in an unclamping direction relative to the first shell body, the angle B being not less than approximately 30°.

9. The connector of claim 8 the angle B is not less than approximately 40°.

10. The connector of claim 5 wherein the maximum displacement of the first and second detent members in a direction normal to the detent pitch circle during biased engagement between adjacent detented positions is not greater than approximately 0.2S.

11. The connector of claim 10 wherein the maximum displacement of the first and second detent members is approximately 0.010.

12. The connector of claim 5 wherein the total surface contact area of engagement is not less than approximately 0.1 times the product of P and W through the angle not less than half of Φ.

13. A self-locking electrical connector comprising:

(a) a first shell body for receiving a first set of contacts;

(b) a threaded clamping ring rotatably coaxially supported on the first shell body for holding the first set of contacts in axial engagement with a second set of contacts;

(c) a multiplicity of first detent members supportively coaxially located in a fixed angular relation to the clamping ring;

(d) a multiplicity of second detent members supportively coaxially located in a fixed angular relation to the first shell body, the first and second detent members being simultaneously engagable on a detent pitch circle having an average detent pitch diameter P and having a detent engagement width W; and (e) biasing means for axially holding the first and second detent members in facing engagement, whereby a total surface contacting area of engagement between the second detent members is at least 0.1 times the product of P and W, the biasing means comprising at least one spring washer, an end cap and a retaining ring, the retaining ring being rigidly retained within the clamping ring, the at least one spring washer being disposed between the second detent members and the end cap, the end cap being axially movable by a force applied by the retaining ring between (i) a non-mated position wherein the at least one spring washer applies less than a desired amount of force to the second detent members and (ii) a mated position wherein the at least one spring washer applies a precise amount of desired force to the second detent members, the end cap being axially movable between the non-mated position and the mated position by axial movement of the clamping ring.

14. The connector of claim 13 wherein the movement of the end cap between the non-mated position and the mated position compresses the at least one spring washer by an additional distance of between about 0.015 inches and about 0.030 inches.

15. The connector of claim 13 wherein the movement of the end cap between the non-mated position and the mated position compresses the at least one spring washer by adding an additional force of between about 100 psi and about 450 psi to the detent members.

16. The connector of claim 13 wherein the first detent members are made of stainless steel and are closely fit into the first shell body, the first detent members being disposed in a first detent member ring locked in place by the second detent members disposed in a second detent member ring, the second detent members having a tooth depth of between about 0.005 inches and about 0.009 inches and being disposed around the full 360° of the second detent member ring.

* * * * *